US009109356B2

(12) United States Patent
Segall

(10) Patent No.: US 9,109,356 B2
(45) Date of Patent: Aug. 18, 2015

(54) RELOCATABLE HABITAT UNIT AND METHOD OF ASSEMBLY

(71) Applicant: Stuart C. Segall, La Jolla, CA (US)

(72) Inventor: Stuart C. Segall, La Jolla, CA (US)

( * ) Notice: Subject to any disclaimer, the term of this patent is extended or adjusted under 35 U.S.C. 154(b) by 0 days.

(21) Appl. No.: 14/222,365

(22) Filed: Mar. 21, 2014

(65) Prior Publication Data

US 2014/0202114 A1 Jul. 24, 2014

Related U.S. Application Data

(62) Division of application No. 12/043,759, filed on Mar. 6, 2008, now Pat. No. 8,677,698.

(51) Int. Cl.

| | |
|---|---|
| ***E04B 2/82*** | (2006.01) |
| ***E04B 1/343*** | (2006.01) |
| ***E04H 1/12*** | (2006.01) |
| ***E04B 1/19*** | (2006.01) |
| *E04B 1/61* | (2006.01) |

(52) U.S. Cl.

CPC ..... *E04B 1/34384* (2013.01); *E04B 1/1903* (2013.01); *E04B 1/34315* (2013.01); *E04B 1/34321* (2013.01); *E04H 1/1205* (2013.01); *E04B 1/6183* (2013.01)

(58) Field of Classification Search

CPC ..... E04B 1/1903; E04B 1/34321; E04B 1/34861; E04B 1/34315; E04B 1/34384; E04B 1/6183

USPC ..... 52/36.2, 79.5, 79.9, 79.12, 79.13, 52/127.6, 127.7, 127.8, 127.11, 127.9, 52/282.1–282.4, 284, 285.1, 285.4, 582.2, 52/589.1, 745.01, 745.02, 745.13; 446/108, 111, 112, 122

See application file for complete search history.

(56) References Cited

U.S. PATENT DOCUMENTS

| | | | | | |
|---|---|---|---|---|---|
| 42,994 | A | * | 5/1864 | Sellers | 70/81 |
| 182,141 | A | * | 9/1876 | Wilson | 292/241 |
| 419,920 | A | * | 1/1890 | Campbell | 217/12 R |
| 797,768 | A | * | 8/1905 | Fisher | 292/204 |
| 1,149,488 | A | * | 8/1915 | Arndt | 292/240 |
| 1,276,932 | A | * | 8/1918 | King | 292/241 |
| 1,651,941 | A | | 12/1927 | Ashkenas | |
| 2,019,692 | A | * | 11/1935 | Mueller | 160/229.1 |
| 2,168,725 | A | * | 8/1939 | Whelan | 52/220.2 |
| 2,581,816 | A | * | 1/1952 | Schlueter | 52/582.2 |
| 2,647,287 | A | * | 8/1953 | Jones | 52/582.2 |
| 2,793,401 | A | * | 5/1957 | Paschke | 52/264 |
| 2,900,678 | A | * | 8/1959 | Curtis | 52/127.8 |
| 2,952,799 | A | * | 9/1960 | Wortman et al. | 361/605 |

(Continued)

FOREIGN PATENT DOCUMENTS

| | | | |
|---|---|---|---|
| CH | 445075 | A * | 10/1967 |
| DE | 1778864 | A1 * | 10/1971 |

(Continued)

*Primary Examiner* — Robert Canfield
*Assistant Examiner* — Charissa Ahmad
(74) *Attorney, Agent, or Firm* — Gary L. Eastman, Esq.

(57) ABSTRACT

A construction set and method for assembling a Relocatable Habitat Unit (RHU) requires a plurality of flat panels that include male (M) and female (F) connectors located on their respective peripheries. The entire RHU can then be assembled using a single, hand-operated tool to engage a selected M with a selected F. First the floor is established and leveled. Next, starting at a corner, the walls are erected around the floor. Finally, the roof is created. A same, hand-operated tool is used for each task.

18 Claims, 2 Drawing Sheets

(56) References Cited

U.S. PATENT DOCUMENTS

| | | | | | |
|---|---|---|---|---|---|
| 3,135,542 | A | * | 6/1964 | Wilkinson | 292/204 |
| 3,236,014 | A | * | 2/1966 | Edgar | 52/270 |
| 3,280,522 | A | * | 10/1966 | Palfey et al. | 52/127.9 |
| 3,281,169 | A | * | 10/1966 | Houvener | 52/582.2 |
| 3,298,145 | A | * | 1/1967 | Minervini et al. | 52/127.9 |
| 3,372,519 | A | * | 3/1968 | Russell | 52/274 |
| 3,391,512 | A | * | 7/1968 | Lopina | 52/768 |
| 3,392,497 | A | * | 7/1968 | Cushman | 52/272 |
| 3,421,459 | A | * | 1/1969 | Sherwood | 108/13 |
| 3,461,633 | A | * | 8/1969 | Ziegelman et al. | 52/643 |
| 3,469,877 | A | * | 9/1969 | Hutchison | 292/241 |
| 3,471,356 | A | * | 10/1969 | Schreiber et al. | 428/317.1 |
| 3,611,667 | A | * | 10/1971 | Maxwell | 52/747.1 |
| 3,622,430 | A | | 11/1971 | Jurisich | |
| 3,645,573 | A | * | 2/1972 | Strang | 292/241 |
| 3,665,791 | A | * | 5/1972 | Carr | 81/125 |
| 3,729,889 | A | * | 5/1973 | Baruzzini | 52/264 |
| 3,758,998 | A | * | 9/1973 | Ollis et al. | 52/79.13 |
| 3,771,273 | A | * | 11/1973 | Brodie | 52/646 |
| 3,818,661 | A | * | 6/1974 | Pragg, III | 52/282.4 |
| 3,832,811 | A | * | 9/1974 | Briel, Jr. | 52/69 |
| 3,913,292 | A | * | 10/1975 | Braekkan | 52/406.1 |
| 4,058,909 | A | * | 11/1977 | Poleri | 434/72 |
| 4,102,097 | A | * | 7/1978 | Zalotay | 52/167.4 |
| 4,158,338 | A | * | 6/1979 | Dippold et al. | 109/79 |
| 4,160,610 | A | * | 7/1979 | Austin-Brown et al. | 403/231 |
| 4,278,834 | A | | 7/1981 | Boundy | |
| 4,308,770 | A | * | 1/1982 | MacDonald | 81/177.2 |
| 4,315,391 | A | * | 2/1982 | Piazza | 52/293.2 |
| 4,364,206 | A | * | 12/1982 | Wybauw | 52/79.7 |
| 4,439,971 | A | * | 4/1984 | Rutherford | 312/263 |
| 4,549,831 | A | * | 10/1985 | Lautenschlager, Jr. | 403/231 |
| 4,559,410 | A | | 12/1985 | Hostetter | |
| D283,783 | S | * | 5/1986 | Park | D8/59 |
| 4,611,841 | A | * | 9/1986 | Ravinet | 292/241 |
| 4,631,881 | A | | 12/1986 | Charman | |
| 4,642,418 | A | | 2/1987 | Menchetti | |
| 4,782,972 | A | * | 11/1988 | Wenkman et al. | 220/4.28 |
| 4,813,726 | A | * | 3/1989 | Ravinet | 292/241 |
| 4,875,312 | A | | 10/1989 | Schwartz | |
| 4,910,932 | A | * | 3/1990 | Honigman | 52/280 |
| 5,038,535 | A | * | 8/1991 | Van Praag, III | 52/127.9 |
| 5,172,529 | A | | 12/1992 | Van De Riet | |
| 5,245,474 | A | | 9/1993 | Chabassier et al. | |
| 5,386,788 | A | * | 2/1995 | Linker et al. | 109/58 |
| 5,425,520 | A | * | 6/1995 | Masumoto | 248/247 |
| 5,555,681 | A | | 9/1996 | Cawthon | |
| 5,619,826 | A | * | 4/1997 | Wu | 52/35 |
| 5,647,181 | A | * | 7/1997 | Hunts | 52/282.1 |
| 5,688,003 | A | * | 11/1997 | Beale | 292/202 |
| 5,698,818 | A | | 12/1997 | Brench | |
| 5,741,032 | A | * | 4/1998 | Chaput | 292/202 |
| 5,768,845 | A | * | 6/1998 | Beaulieu et al. | 52/585.1 |
| 5,787,665 | A | * | 8/1998 | Carlin et al. | 52/309.4 |
| 5,788,395 | A | * | 8/1998 | Grieser et al. | 403/231 |
| 5,960,592 | A | * | 10/1999 | Lilienthal et al. | 52/79.1 |
| 6,101,773 | A | | 8/2000 | Chau et al. | |
| 6,119,427 | A | | 9/2000 | Wyman et al. | |
| 6,178,701 | B1 | * | 1/2001 | De Paepe et al. | 52/36.2 |
| 6,279,287 | B1 | | 8/2001 | Meadows | |
| 6,523,868 | B1 | * | 2/2003 | Timothy | 292/241 |
| 6,523,869 | B1 | * | 2/2003 | Jensen et al. | 292/336.3 |
| 6,530,630 | B2 | * | 3/2003 | Austin et al. | 312/265.4 |
| 6,568,723 | B2 | * | 5/2003 | Murphy et al. | 292/241 |
| 6,609,338 | B2 | * | 8/2003 | Hightower | 52/204.65 |
| 6,626,017 | B2 | * | 9/2003 | Ruhl et al. | 70/63 |
| 6,658,904 | B2 | * | 12/2003 | Herbeck et al. | 70/63 |
| 6,662,508 | B1 | * | 12/2003 | Else | 52/177 |
| 6,676,234 | B2 | * | 1/2004 | Herbeck et al. | 312/265.4 |
| 6,786,009 | B1 | * | 9/2004 | McGunn et al. | 52/36.2 |
| 6,892,498 | B1 | * | 5/2005 | Roman | 52/79.5 |
| 6,955,204 | B1 | | 10/2005 | Gilbert et al. | |
| 7,150,208 | B2 | * | 12/2006 | Debley | 81/59.1 |
| 7,334,377 | B2 | * | 2/2008 | Dubensky et al. | 52/780 |
| 7,495,181 | B2 | | 2/2009 | Matsushita et al. | |
| 7,540,115 | B2 | | 6/2009 | Metcalf et al. | |
| 7,665,775 | B1 | * | 2/2010 | Miller et al. | 292/240 |
| 7,716,895 | B2 | * | 5/2010 | Fairorth et al. | 52/582.2 |
| 7,922,223 | B2 | * | 4/2011 | Lawrence | 292/241 |
| 7,954,294 | B2 | * | 6/2011 | Appleford | 52/582.2 |
| 7,956,793 | B2 | | 6/2011 | Puscasu et al. | |
| 8,474,193 | B2 | | 7/2013 | Sutton et al. | |
| 8,514,354 | B2 | | 8/2013 | Amimori et al. | |
| 8,677,698 | B2 | * | 3/2014 | Segall | 52/127.9 |
| 8,803,107 | B2 | | 8/2014 | Delpech et al. | |
| 2002/0095888 | A1 | * | 7/2002 | Winskye | 52/234 |
| 2003/0035917 | A1 | | 2/2003 | Hyman | |
| 2003/0082357 | A1 | * | 5/2003 | Gokay et al. | 428/212 |
| 2006/0083866 | A1 | | 4/2006 | Hanelt | |
| 2006/0277852 | A1 | * | 12/2006 | Mower et al. | 52/270 |
| 2007/0044411 | A1 | * | 3/2007 | Meredith et al. | 52/586.1 |
| 2007/0175115 | A1 | * | 8/2007 | Price | 52/169.12 |
| 2008/0257599 | A1 | | 10/2008 | Matsushita et al. | |
| 2008/0282623 | A1 | * | 11/2008 | Powell | 52/71 |
| 2009/0107056 | A1 | * | 4/2009 | Kirilichin et al. | 52/79.1 |
| 2009/0165401 | A1 | * | 7/2009 | Smalley, III | 52/91.3 |
| 2009/0167971 | A1 | | 7/2009 | Powers et al. | |
| 2009/0193740 | A1 | | 8/2009 | Bennett | |
| 2010/0018131 | A1 | * | 1/2010 | Green | 52/79.5 |
| 2011/0025973 | A1 | | 2/2011 | Kaneiwa et al. | |
| 2011/0047912 | A1 | | 3/2011 | Armijo | |
| 2011/0268925 | A1 | | 11/2011 | Kagawa | |
| 2012/0162996 | A1 | | 6/2012 | Ikeda | |
| 2013/0042556 | A1 | | 2/2013 | Armijo | |
| 2013/0055669 | A1 | | 3/2013 | Olszewski et al. | |
| 2013/0308085 | A1 | | 11/2013 | Ikeda et al. | |

FOREIGN PATENT DOCUMENTS

| | | | |
|---|---|---|---|
| FR | 2172532 | A5 * | 9/1973 |
| WO | WO 2006001824 | A1 * | 1/2006 |

* cited by examiner

RELOCATABLE HABITAT UNIT AND METHOD OF ASSEMBLY

RELATED APPLICATION

This application is a Divisional of, and claims the benefit of priority to U.S. patent application Ser. No. 12/043,759, filed on Mar. 6, 2008, entitled Relocatable Habitat Unit, and currently co-pending.

FIELD OF THE INVENTION

The present invention pertains generally to Relocatable Habitat Units (RHUs) for use in simulating an environment for a military combat training scenario. More particularly, the present invention pertains to an RHU that can be assembled and disassembled on-site, using panels that can be maneuvered, positioned and interconnected by no more than two men. The present invention is particularly, but not exclusively, useful as a system and method for the complete assembly of an RHU using only a same, single, hand-operated tool.

BACKGROUND OF THE INVENTION

Military training must necessarily be conducted in an environment that will simulate anticipated combat operations as accurately as possible. For a comprehensive training program, this requires the ability and flexibility to relocate and set-up several different types of training environments. In general, training sites may need to selectively simulate either an urban, suburban or an open terrain environment.

For a training site, the realism that can be attained when simulating a particular environment can be dearly enhanced by introducing indigenous persons (i.e. actors) into the training scenario. Further, in addition to the indigenous persons, urban and suburban environments can be made even more realistic when trainees are confronted by obstacles, such as buildings (e.g. habitats). In most instances, such structures can be relatively modest. Nevertheless, their integration into the training scenario requires planning.

Providing realistic buildings for a training environment requires the collective consideration of several factors. For one, the buildings need to present a visual perception that is accurate for the particular training scenario. Stated differently, they need to "look the part". For another, it is desirable that structures assembled on the training site be capable of disassembly for relocation to another training site and subsequent use. With this last point in mind, an ability to easily assemble and disassemble a building (i.e. training aide) is a key consideration.

Heretofore, military combat training scenarios have been conducted either on open terrain, or at locations where there have been pre-existing buildings. The alternative has been to bring prefabricated components of buildings to a training site, and then assemble the components to create the building. Typically, this has required special equipment and considerable man-hours of labor.

In light of the above, it is an object of the present invention to provide a construction set and method for assembling and disassembling an RHU, at a training site, with as few as two persons. Still another object of the present invention is to provide a construction set that requires the use of only a same, single, hand operated tool for the assembly and disassembly of an entire RHU. Yet another object of the present invention is to provide a construction set for the assembly and disassembly of an entire RHU that is relatively simple to manufacture, is extremely simple to use, and is comparatively cost effective.

SUMMARY OF THE INVENTION

A Relocatable Habitat Unit (RHU) in accordance with the present invention is assembled using a plurality of substantially flat panels. For this assembly operation, each panel includes male (M) and female (F) connectors. Specifically, these connectors are located along the periphery of the panel. Importantly, all of the male connectors can be engaged with a respective female connector using the same tool. Thus, an entire RHU can be assembled and disassembled in this manner. Further, each panel is sufficiently lightweight to be moved and positioned by one person. As a practical matter, a second person may be required to use the tool and activate the connectors as a panel is being held in place by the other person.

In detail, a construction set for use with the present invention includes a plurality of panels and only the one tool. Each panel has a periphery that is defined by a left side edge, a right side edge, a top edge and a bottom edge. Selected panels, however, can have different configurations that include a door or a window. Still others may simply be a solid panel. In particular, solid panels are used for the floor and ceiling (roof) of the RHU. Essentially, there are wall panels, floor panels, and ceiling panels. Each panel, however, regardless of its configuration, will include at least one male connector and at least one female connector that are located on its periphery.

In addition to the wall, floor, and ceiling panels, the construction set also includes corner connections and ceiling attachments. Specifically, corner connections are used to engage wall panels to each other at the corners of the RHU. The ceiling attachments, on the other hand, allow engagement of roof panels with the top edges of wall panels.

The placement and location of male (M) and female (F) lock connectors on various panels of the construction set is important. Specifically, along the right side edge of each wall panel, between its top edge and bottom edge, the lock configuration is (FMMF). Along its left side edge, the lock configuration is (MFFM). Further, along the top edge the lock configuration is (MM), and along the bottom edge it is (M or F [depending on the connector of the floor panel]).

Unlike the panels, the corner connections are elongated members with two surfaces that are oriented at a right angle to each other. The lock configurations for a corner connection are (F-F) along one surface and (-FF-) along the other surface. Like the corner connections, the ceiling attachments also present two surfaces that are at a right angle to each other. Their purpose, however, is different and accordingly they have a (FF) lock configuration on one surface for engagement with the fop edge of a wall panel. They also have either a (MM) or a (FF) configuration along the other surface for connection with a ceiling panel.

Importantly, in addition to the above mentioned panels, connections and attachments, the construction set of the present invention includes a single hand tool. Specifically, this hand tool is used for activating the various male (M) connectors for engagement with a female (F) connector. For the present invention, this tool preferably includes a hex head socket, a drive that holds the hex head socket, and a ratchet handle that is swivel attached to the drive.

For assembly of the RHU, the first task is to establish a substantially flat floor. This is done by engaging male (M) connectors on a plurality of floor panels with female (F) connectors on other floor panels. The floor is then leveled using extensions that can be attached to the floor. Next, a wall is erected around the floor of the RHU by engaging a male connector on the right side edge of a respective wall panel with a female connector on the left side edge of an adjacent wall panel. Recall, the lock configurations on the left and right edges of wall panels are, respectively, (FMMF) and (MFFM). Additionally, the bottom edge of each panel in the wall is engaged to the floor using mutually compatible male (M) and female (F) connectors. Finally, the roof is created for the RHU by engaging male (M) connectors on ceiling panels with female (F) connectors on other ceiling panels. The ceiling attachments are then engaged to the assembled roof. In turn, the ceiling attachments are engaged to the top edge of a wall panel using mutually compatible male (M) and female (F) connectors. All connections for the assembly of the RHU are thus accomplished using the same tool.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
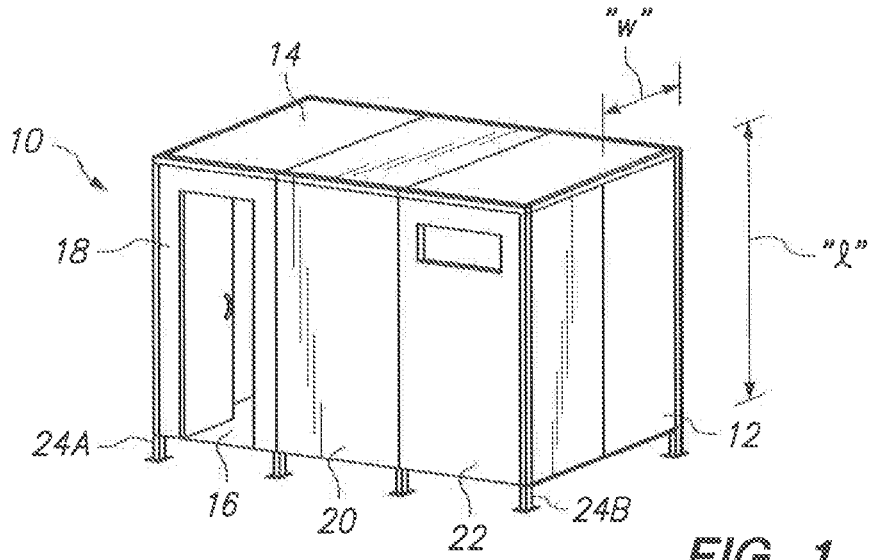
FIG. 1 is a perspective view of an assembled Relocatable Habitat Unit (RHU) in accordance with the present invention.

Referring initially to FIG. 1, a Relocatable Habitat Unit (RHU) in accordance with the present invention is shown and is generally designated 10. As shown, the RHU 10 includes a plurality of individual panels, of which the generic panel 12 (sometimes hereinafter referred to as a wall panel) is exemplary. The panel 12 is substantially flat, and is rectangular in shape with a width "w" of approximately four feet and a length "l" of approximately eight feet (i.e. the panel 12 is a 4×8). Alternatively, a panel 12 may be dimensioned as a 4×4. The depth of the panel 12 can vary slightly but, in general, will only be two or three inches. Preferably, the panel 12 is made of a light-weight composite polymer foam type material.

For the present invention there are essentially three different types of panels 12. These are generally denominated by their structural function in the RHU 10 and are: a wall panel 12, a ceiling panel 14 and a floor panel 16. Further, the wall panels 12 may have any of three different configurations. Specifically, these configurations are shown in FIG. 1, and are: a door panel 18, a solid panel 20 and a window panel 22. Regardless of configuration, however, the exterior of each wall panel 12 can be dressed to appropriately simulate the desired indigenous environment. FIG. 1 also shows that the RHU 10 is supported by a plurality of adjustable extensions, of which the extensions 24*a* and 24*b* are exemplary.

Figure 2:
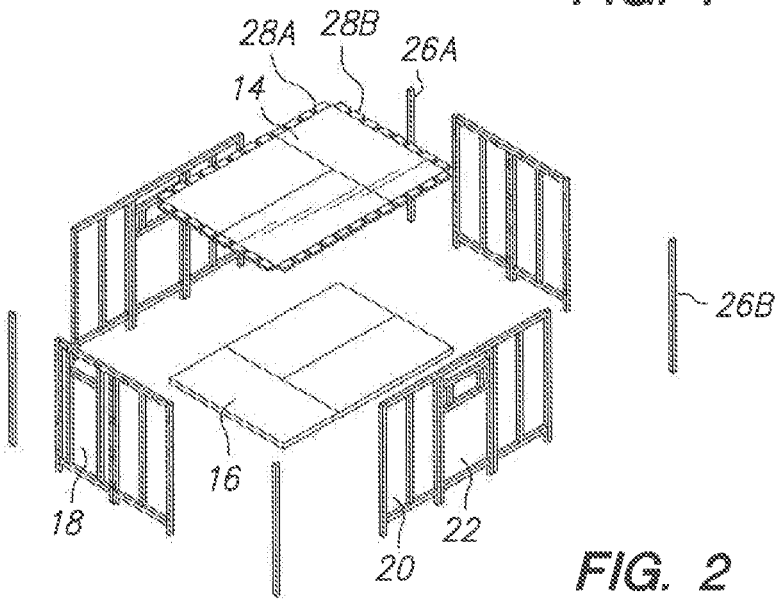
FIG. 2 is an exploded perspective view of an RHU.

FIG. 2 shows that in addition to the panels 12, the RHU 10 includes a plurality of corner connections 26, of which the corner connections 26*a* and 26*b* are exemplary. Further, FIG. 2 shows there is a plurality of ceiling attachments 28, of which the ceiling attachments 28*a* and 28*b* are exemplary. As will be more fully appreciated with further disclosure, these corner connections 26 and ceiling attachments 28 are used to interconnect panels 12.

Figure 3:
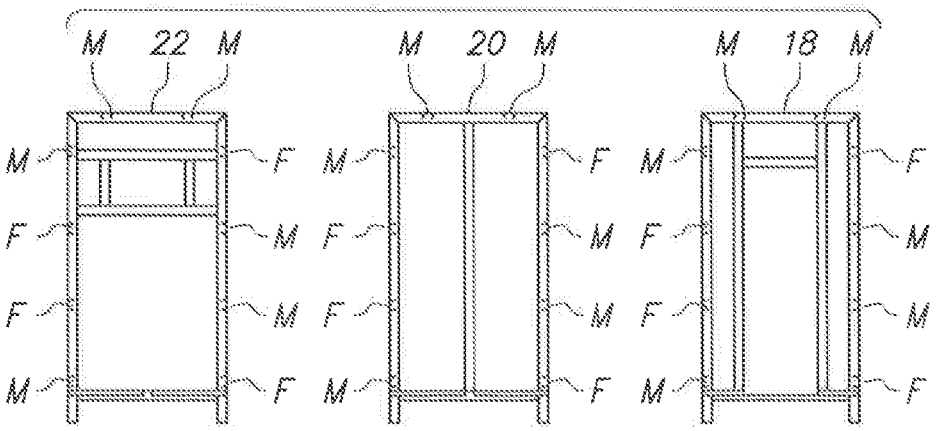
FIG. 3 is an elevation view of three panels for an RHU shown positioned for connection of their respective male (M) and female (F) connectors.

It is an important aspect of the present invention that the panels 12, the corner connections 26 and the ceiling attachments 28 have compatible male (M) and female (F) locking connectors. For example, FIG. 3 shows a door panel 18, a solid panel 20 and a window panel 22 placed in side-by-side relationship with their respective M and F locking connectors positioned for engagement. Details of the structure involved will, perhaps, be best appreciated by cross referencing FIG. 3 with FIG. 4.

Figure 4:
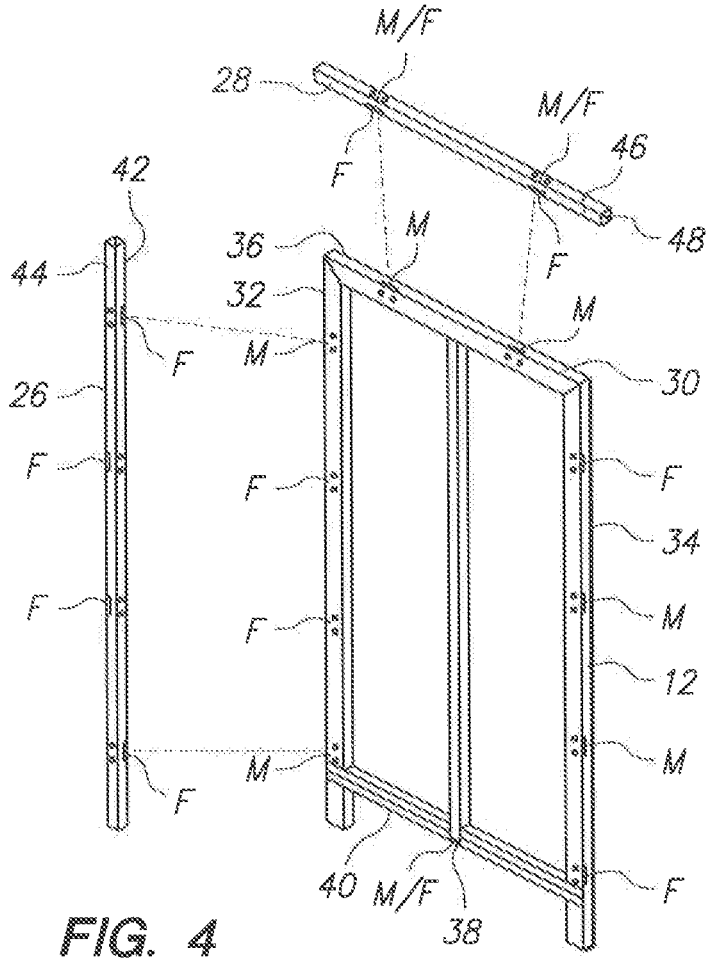
FIG. 4 is a perspective view of a single wall panel of an RHU positioned for engagement with a corner section and a ceiling attachment.

In FIG. 4 a panel 12 is shown to have a substantially rectangular periphery 30 that is defined by a left side edge 32, a right side edge 34, a top edge 36 and a bottom edge 38. Further, FIG. 4 shows that the panel 12 includes a ledge 40 that extends along the bottom edge 38 and outwardly from the periphery 30. The purpose of ledge 40 is to rest on a floor panel 16 of an assembled RHU 10 (i.e. when a wall panel 12 has been engaged with the floor panel 16), to thereby provide additional support for the panel 12.

FIG. 4 also shows that a corner connection 26 is an elongated member having a first surface 42 and a second surface 44. For purposes of the present invention, the first surface 42 needs to be oriented at a right angle (i.e. orthogonal) to the second surface 44. Importantly, the first surface 42 is provided with F locking components that are aligned as (F-F). Thus, the first surface 42 of corner connection 26 is compatible with the alignment (MFFM) shown for locking connectors on the left side edge 32 of the panel 12. Stated differently, the top and bottom M lock connectors on the left edge 32 of panel 12 will lock, respectively, with the top and bottom F lock connectors on first surface 42 of corner connection 26. Note also that the alignment of locking connectors on the second surface 44 of corner connection 26 is (-FF-), This is likewise compatible with the alignment (FMMF) that is typical for the right side edge 34 of a panel 12 (see also FIG. 3).

Like the corner connections 26, the ceiling attachments 28 are elongated members. Also, the ceiling attachments 28 have a first surface 46 and a second surface 48. Like the corner connections 26, the first surface 46 of the ceiling attachment 28 needs to be oriented at a right angle (i.e. orthogonal) to its second surface 48. The similarities end there, however. As shown in FIG. 4, the second surface 48 of the ceiling attachment 28 includes a pair of F locking connectors that will interact with respective M locking connectors along the top edge 36 of the panel 12. On the other hand, the first surface 46 may have either M or F locking connectors for engagement with a ceiling panel 14.

Figure 5:
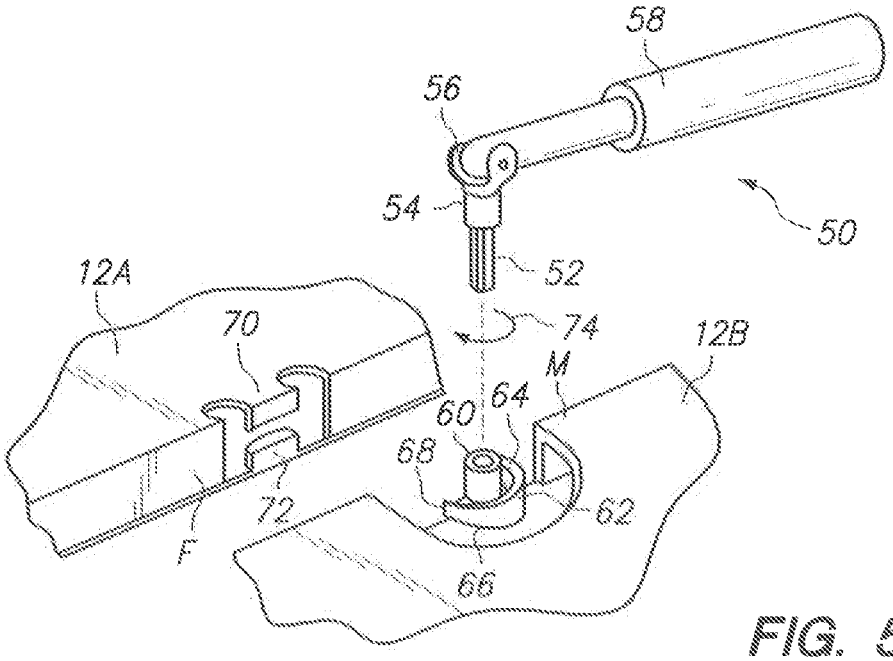
FIG. 5 is a perspective view of portions of two panels from an RHU, with portions broken away to show the interaction of male (M) and female (F) connectors in their operational relationship with a tool that is used to assemble the RHU in accordance with the present invention.

The interaction of M and F locking connectors will be best appreciated with reference to FIG. 5. There it will be seen that the present invention employs a tool, generally designated 50. As shown, the tool 50 includes a hex head 52 that is connected to a drive 54. It will be appreciated by the skilled artisan that the hex head 52 shown in FIG. 5, however, is only exemplary of head configurations that may be used for the present invention, In any event, the drive 54 is connected to a swivel ratchet 56 that, in turn, is connected to a handle 58. As envisioned for the present invention, this tool 50 is all that is required to assemble the RHU 10.

Still referring to FIG. 5, it will be seen that the panel portions 12*a* and 12*b* have respective F and M locking connectors. As envisioned for the present invention, all M and F locking connectors used for the RHU 10 of the present invention are substantially identical. In detail, the M locking connector is shown to include a hex socket 60 with an attached cam lock 62. Further, the cam lock 62 is shown to have an upper ramp 64 and a lower ramp 66 that are inclined so there is an increasing taper extending from end 68 back to the hex socket 60. In contrast, the F locking connector on panel 12*a* is shown to include an upper abutment 70 and a lower abutment 72.

For an engagement between an M and an F locking connector, the connectors need to first be juxtaposed with each other. This can be accomplished in any of several ways. For instance, either side edges 32/34 of panels 12 are juxtaposed to each other (e.g. see FIG. 3); ceiling panels 14 and floor panels 16 are respectively juxtaposed (see FIG. 2); a corner connection 26 is juxtaposed with a side edge 32/34 of a panel 12 (e.g. see FIG. 4); a ceiling attachment 28 is juxtaposed with the top edge 36 of a panel 12 or with a ceiling panel 14; or the bottom edge 38 of a panel 12 is juxtaposed with a floor panel 16. In each case, it is important that an M locking connector be positioned opposite an F locking connector.

Once an M and an F locking connector have been properly positioned with each other, as indicated above, the hex head 52 of tool 50 is inserted into the hex socket 60. The tool 50 is then turned in the direction of arrow 74. This causes the ramps 64/66 of cam lock 62 to respectively go behind the abutments 70/72. The M and F locking connectors are then engaged.

In accordance with the present invention, assembly of the RHU 10 is best accomplished by following a predetermined sequence of steps. First, a plurality of floor panels 16 is engaged together to form a floor for the RHU 10. The floor is then positioned and leveled by adjusting the extensions 24 that are provided for that purpose. Next, starting at a corner for the RHU 10, a corner connection 26 is engaged with panels 12. Note: at this point the respective ledges 40 on panels 12 are positioned to rest on the adjacent floor panel 16. Also, the bottom edges 38 of the wall panels 12 are engaged through M/F locking connections to the adjacent floor panel 16. This continues until all wails of the RHU 10 have been erected. As intended for the present invention, door panels 18, solid panels 20 and window panels 22 can be used as desired in the assembly of the walls for the RHU 10.

After the walls of RHU 10 have been erected, the roof is created. Specifically, ceiling attachments 28 are engaged, as required, with a single ceiling panel 14 (see FIG. 2). This ceiling panel 14, with its ceiling attachments 28, is positioned so the ceiling attachments 28 can be connected, via M/F locking connectors, to the top edges 36 of respective panels 12. Additional ceiling panels 14 and their associated ceiling attachments 28 can then be similarly created, positioned and connected to other ceiling panels 14 and other wall panels 12, to complete the roof. The RHU 10 is thus assembled, and appropriate set dressing can then be added.

Importantly, all of the tasks described above for the assembly of an RHU 10 are accomplished using only the tool 50. Axiomatically, it follows that the entire RHU 10 is held together with only a plurality of M/F locking connections.

While the particular Relocatable Habitat Unit as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A method for assembling a relocatable habitat unit comprising the steps of;

providing a base plurality of substantially flat panels, with each panel having a periphery defined by a left side edge, a right side edge, a top edge and a bottom edge, wherein each panel includes at least one male connector and at least one female connector located on the periphery thereof, wherein each substantially flat panel includes a plurality of male connectors disposed along the left side edge and the right side edge, wherein the left side edge and the right side edge of each substantially flat panel includes and equal number of female connectors, disposed in opposing sequences and located on the periphery thereof such that when the left side edge of the substantially flat panel abuts the right side edge of another substantially flat panel each male connector abuts a female connector, wherein each substantially flat panel includes a plurality of male connectors disposed along the top edge and the bottom edge of each substantially flat panel, wherein the top edge and bottom edge of each substantially flat panel include an equal number of female connectors, disposed in opposing sequences and located on the periphery thereof such that when the top edge of the substantially flat panel abuts the bottom edge of another substantially flat panel each male connector abuts a female connector, wherein each male connector comprises a socket mounted on the substantially flat panel and a cam lock affixed to the socket for rotation therewith, wherein the cam lock includes a first ramp and an opposed second ramp, with the ramps inclined to for decreasing taper with increased distance from the socket, and wherein each female connector comprises a first abutment and a second abutment formed on the substantially flat panel, with the second abutment being distant from the first abutment for simultaneous engagement with the respective ramp on the male connector to hold the respective panels together;

providing a first plurality of panels selected from the base plurality for use as interchangeable wall panels;

providing a second plurality of panels selected from the base plurality for use as ceiling panels;

providing a third plurality of panels selected from the base plurality for use as floor panels;

establishing a substantially flat floor by engaging male connectors on the floor panels with female connectors on adjacent floor panels;

leveling the floor;

erecting a wall around the floor by engaging a male/female connector on the right side edge of the interchangeable wall panel with a female/male connector on the left side edge of adjacent interchangeable wall panel and engaging the bottom edge of each interchangeable wall panel in the wall to the floor panels of the floor using mutually compatible male and female connectors;

creating a roof by engaging male connectors on the ceiling panels with female connectors on adjacent ceiling panels and engaging the top edge of each interchangeable wall panel in the wall to the ceiling panels in the roof using mutually compatible male and female connectors; and manipulating a single hand tool for accomplishment of the establishing, erecting and creating steps.

2. The method as recited in claim 1 wherein each substantially flat panel is substantially rectangular shaped.

3. The method as recited in claim 1 wherein each substantially flat panel is made of a composite polymer foam material.

4. The method as recited in claim 1 wherein the first plurality of panels selected from the base plurality for use as interchangeable wall panels further comprising at least one door panel and at least one window panel.

5. The method as recited in claim 1 wherein each interchangeable wall panel further comprises a ledge extending along a bottom edge thereof and extending outwardly therefrom.

6. The method as recited in claim 1 further comprising a plurality of corner connections, wherein each corner connection is an elongated member with a first surface having at least one female connector located thereon and a second surface having at least one female connector located thereon, and wherein the first surface is substantially orthogonal to the second surface for interconnecting a left side edge of a first panel with a right side edge of a second panel.

7. The method as recited in claim 1 further comprising a plurality of ceiling attachments, wherein each ceiling attachment is an elongated member with a first surface having at least one female connector located thereon and a second surface having at least one connector located thereon, wherein the connector on the second surface is selected from a group comprising a male connector and a female connector, and wherein the first surface is substantially orthogonal to the second surface for interconnecting a ceiling panel with the top edge of a wall panel.

8. The method as recited in claim 1 wherein the tool comprises a head, a drive for holding the head, and a handle connected to the drive, and further wherein the manipulating step is accomplished by the steps of;

inserting the head of the tool into the socket of the male (M) connector; and rotating the tool with its handle to engage the cam lock of the male (M) connector with the abutments of the female (F) connector to hold the respective panels together.

9. The method as recited in claim 8 wherein the head is a hex head wrench and the socket is a hex socket.

10. The method as recited in claim 1, further comprising providing adjustable extensions extending downward from the substantially flat floor wherein the floor is leveled by adjusting the adjustable extensions.

11. A method for assembling a relocatable habitat unit comprising the steps of:

providing a base plurality of substantially flat panels, with each panel having a periphery defined by a left side edge, a right side edge, a top edge and a bottom edge, wherein each substantially flat panel includes a plurality of male connectors disposed along the left side edge and the right side edge of each substantially flat panel, wherein the left side edge and right side edge of each substantially flat panel includes an equal number of female connectors, disposed in opposing sequences and located on the periphery thereof such that when the left side edge of the substantially flat panel abuts the right side edge of another substantially flat panel each male connector abuts a female connector, wherein each substantially flat panel includes a plurality of male connectors disposed along the top edge and the bottom edge of each substantially flat panel, wherein the top edge and bottom edge of each substantially flat panel include an equal number of female connectors, disposed in opposing sequences and located on the periphery thereof such that when the top edge of the substantially flat panels abuts the bottom edge of another substantially flat panel each male connector abuts a female connector, wherein each male connector comprises a socket mounted on the substantially flat panel and a cam lock affixed to the socket for rotation therewith, wherein the cam lock includes a first ramp and an opposed second ramp, with the ramps inclined to form a decreasing taper with increased distance from the socket, wherein each female connector comprises a first abutment and a second abutment formed on the substantially flat panel, with the second abutment being distanced from the first abutment for simultaneous engagement with the respective ramp on the male connector to hold the respective panels together;

providing a hand tool with a head for rotating the socket of one male connector on the substantially flat panel about its axis of rotation for engagement with one female connector on another substantially flat panel to fixedly join the substantially flat panels together;

providing a first plurality of panels selected from the base plurality for use as interchangeable wall panels;

providing a second plurality of panels selected from the base plurality for use as ceiling panels;

providing a third plurality of panels selected from the base plurality for use as floor panels;

establishing a substantially flat floor by engaging male connectors with female connectors of said floor panels;

leveling the substantially flat floor;

providing a plurality of corner connections, wherein each corner connection is an elongated member having a first end and a second end with a first surface and a second surface extending therebetween, wherein the first surface is substantially orthogonal to the second surface, and wherein the first surface and the second surface have a respective plurality of male and female connectors located thereon;

engaging the corner connections to the corresponding floor panel at each corner of the substantially flat floor;

engaging the interchangeable wall panels to the corner connections and adjacent interchangeable wall panels and floor panels to create a wall around the substantially flat floor;

providing a plurality of ceiling attachments, wherein each ceiling attachment is an elongated member having a first end and a second end with a first surface and a second surface extending therebetween, wherein the first surface is substantially orthogonal to the second surface, and wherein the first surface and the second surface have a respective plurality of male and female connectors, wherein the second surface has a plurality of connectors equal and opposite to that of the second surface;

engaging the ceiling attachments to the interchangeable wall panels of the wall;

engaging the ceiling panels to the ceiling attachments and to adjacent ceiling panels to create a ceiling; and manipulating the hand tool for accomplishment of the establishing, erecting, engaging and creating steps.

12. The method as recited in claim 11 wherein each substantially flat panel is substantially rectangular shaped.

13. The method as recited in claim 11 wherein each substantially flat panel is made of a composite polymer foam material.

14. The method as recited in claim 11 wherein the first plurality of panels selected from the base plurality for use as interchangeable wall panels further comprises a ledge extending along a bottom edge thereof and extending outwardly therefrom.

15. The method as recited in claim 11 wherein the first plurality of panels selected from the base plurality for use as interchangeable wall panels further comprises at least one door panel and at least one window panel.

16. The method as recited in claim 11 wherein the tool further comprises a drive for holding the head and a handle connected to the drive and further wherein the manipulating step is accomplished by the steps of:

inserting the head of the tool into the socket of the male (M) connector; and rotating the tool with its handle to engage the cam lock of the male (M) connector with the abutments of the female (F) connector to hold the respective panels together.

17. The method as recited in claim 16 wherein the head is a hex head wrench and the socket is a hex socket.

18. The method as recited in claim 11, further comprising providing adjustable extensions extending downward from the substantially flat floor wherein the floor is leveled by adjusting the adjustable extensions.

* * * * *

UNITED STATES PATENT AND TRADEMARK OFFICE

CERTIFICATE OF CORRECTION

PATENT NO. : 9,109,356 B2
APPLICATION NO. : 14/222365
DATED : August 18, 2015
INVENTOR(S) : Stuart C. Segall It is certified that error appears in the above-identified patent and that said Letters Patent is hereby corrected as shown below:

In the Claims

Column 6, line 37 change 'distant' to --distanced--

Signed and Sealed this
Twenty-ninth Day of December, 2015

Michelle K. Lee

Michelle K. Lee
*Director of the United States Patent and Trademark Office*